US010246910B2

(12) United States Patent
Haber

(10) Patent No.: US 10,246,910 B2
(45) Date of Patent: Apr. 2, 2019

(54) CABLE ACTUATED DIGITAL VEHICLE CARGO SECURITY SYSTEM

(71) Applicant: Greg Haber, Woodbury, NY (US)

(72) Inventor: Greg Haber, Woodbury, NY (US)

( * ) Notice: Subject to any disclaimer, the term of this patent is extended or adjusted under 35 U.S.C. 154(b) by 74 days.

(21) Appl. No.: 15/456,708

(22) Filed: Mar. 13, 2017

(65) Prior Publication Data

US 2018/0261135 A1 Sep. 13, 2018

(51) Int. Cl.

| | |
|---|---|
| ***E05B 83/02*** | (2014.01) |
| ***G09F 3/03*** | (2006.01) |
| ***E05B 39/00*** | (2006.01) |
| ***E05B 39/04*** | (2006.01) |

(52) U.S. Cl.

CPC ..... *E05B 83/02* (2013.01); *E05B 39/00* (2013.01); *E05B 39/04* (2013.01); *G09F 3/0352* (2013.01); *G09F 3/0394* (2013.01)

(58) Field of Classification Search

None

See application file for complete search history.

(56) References Cited

U.S. PATENT DOCUMENTS 830,565 A * 9/1906 Brown ..... F16G 11/108 292/307 R
3,770,307 A * 11/1973 Van Gompel ..... G09F 3/0352 24/115 H
4,747,631 A * 5/1988 Loynes ..... G09F 3/0352 24/136 A
5,222,776 A * 6/1993 Georgopoulos ..... G09F 3/0352 292/252
5,647,620 A * 7/1997 Kuenzel ..... B65D 55/06 292/307 R
6,155,617 A * 12/2000 Kuenzel ..... G09F 3/0352 292/307 R
7,073,828 B2 * 7/2006 Foigel ..... B65D 90/008 24/115 L
8,938,998 B2 * 1/2015 Haber ..... E05B 47/0038 292/251.5
9,856,896 B2 * 1/2018 Chua ..... F16G 11/106
2006/0290147 A1 * 12/2006 Liroff ..... G09F 3/0352 292/327

(Continued)

FOREIGN PATENT DOCUMENTS

GB 2368174 A * 4/2002 ..... E05B 39/04

*Primary Examiner* — Catherine A Kelly

(74) *Attorney, Agent, or Firm* — Epstein Drangel LLP; Robert L. Epstein

(57) ABSTRACT

The access door to the cargo compartment has a latch handle with an opening. The handle is moveable between a closed position, wherein the handle opening is aligned with an opening in a part attached to the door, and an open position, wherein the handle opening is out of alignment with the opening in the attached part. A cable is provided having an end anchored to the cargo door and a free end adapted to extend through the aligned openings, when handle is in its closed position. A magnetic rocker member is spring-loaded toward a magnetically actuated switch and causes a friction wheel to securely retain the free end of the cable. The switch causes the number on a digital counter to change in response to the depression of the button, allowing removal of the cable end. The changed number indicates that the compartment may have been accessed during transit.

8 Claims, 5 Drawing Sheets

(56) References Cited

U.S. PATENT DOCUMENTS

| | | | | |
|---|---|---|---|---|
| 2009/0199606 | A1* | 8/2009 | Gil | G06K 19/07798 70/440 |
| 2010/0283580 | A1* | 11/2010 | Sheng | B65D 90/22 340/5.31 |
| 2017/0178546 | A1* | 6/2017 | Kleynerman | E05B 39/02 |

* cited by examiner

CABLE ACTUATED DIGITAL VEHICLE CARGO SECURITY SYSTEM

BACKGROUND OF THE INVENTION

1. Field of the Invention

The present invention relates to cargo security systems, and more particularly to a security system for the protection of cargo located in an enclosed compartment of a vehicle such as a truck which indicates that the vehicle cargo area may have been accessed by opening the door to the cargo compartment during transit.

2. Description of Prior Art Including Information Disclosed Under 37 CFR 1.97 and 1.98

Currently, it is very common for trucks used to transport cargo to utilize a plastic or metal seal attached to the handle of the latch of the access door of the cargo compartment. The physical seal is attached by the shipper after the truck is loaded with the cargo and the cargo door has been closed, before the truck leaves the shipper to travel to its destination.

In order to open the truck door and access the cargo, it is necessary to move the latch handle which requires the seal to be removed. Thus, the physical seal acts as a visual indicator as to whether the access door to the cargo compartment has been opened during transit. At the destination, the recipient observes the physical seal when the truck arrives, before the vehicle door is opened. If the seal remains intact, the recipient knows that the cargo access door has not been opened and thus the cargo has not been tampered with during transit. If the seal is broken, the recipient knows that the cargo access door may have been opened, permitting access to the cargo and thus may not accept the shipment.

However, the physical seal has an inherent disadvantage. Since it is exposed to the elements during transit, it is subject to being damaged or broken for reasons other than accessing the cargo, causing the shipper to refuse the shipment even though the cargo may be intact.

In order to provide a more reliable way of determining whether cargo is secure during transit, an improved digital vehicle cargo security system was invented and is the subject of U.S. Pat. No. 8,004,393, issued Aug. 23, 2011. The patented system includes a digital counter having a display. The number on the counter is automatically set after the cargo area is secured by the latch being moved to the position where the truck bed is engaged by the J-hook to keep the access door of the cargo compartment closed The system senses if the latch is moved to disengage the J-hook, meaning that the cargo area may have been accessed after the cargo area was secured, and causes the number on the counter to change in response. The original number set on the counter by the shipper is forwarded to the destination by shipping documents, the internet or any other means. At the destination, it can be determined if the cargo area may have been accessed in transit by comparing the original number and the number displayed on the counter when the vehicle reaches the destination location.

The patented digital vehicle cargo security system functions well and is currently used on many vehicles. However, it requires a custom designed lock to replace the latch which is provided at the factory by the vehicle manufacturer. The custom lock is designed to be mounted on the exterior of the cargo door and must be strong enough to prevent tampering or attack. It therefore requires a thick metal housing which adds substantial weight to the vehicle door.

There is a need for a simpler, less expensive, highly reliable vehicle security system which can work with the factory supplied latch and thus does not require an expensive, heavy custom replacement lock.

BRIEF SUMMARY OF THE INVENTION

It is, therefore, a prime object of the present invention to provide a cable actuated digital vehicle cargo security system.

It is another object of the present invention to provide a cable actuated digital vehicle cargo security system that may be used with any factory installed latch that can accept a physical seal.

It is another object of the present invention to provide a cable actuated digital vehicle cargo security system that does not require a custom lock for the cargo access door.

It is another object of the present invention to provide a cable actuated digital vehicle cargo security system that does not add significantly to the weight of the cargo access door.

It is another object of the present invention to provide a cable actuated digital vehicle cargo security system that does not require a padlock or other external lock mechanism.

It is another object of the present invention to provide a cable actuated digital vehicle cargo security system that utilizes a looped cable which if removed actuates a digital counter to change a displayed number if the cargo compartment may have been accessed during transit.

It is another object of the present invention to provide a cable actuated digital vehicle cargo security system in which the cable is associated with the handle of a standard factory installed latch.

It is another object of the present invention to provide a cable actuated digital vehicle cargo security system contained a small, light-weight housing mounted to the cargo access door proximate the latch handle.

It is another object of the present invention to provide a cable actuated vehicle cargo security system in which the latch handle has an opening normally adapted to receive a seal, wherein one end of a cable extends through the handle opening.

It is another object of the present invention to provide a cable actuated digital vehicle cargo security system in which the free end of the cable is retained within the housing.

It is another object of the present invention to provide a cable actuated vehicle cargo security system in which the other end of a cable is permanently anchored to the cargo door within the housing.

It is another object of the present invention to provide a cable actuated digital vehicle cargo security system in which the end of the cable is retained in the housing by a spring-loaded friction wheel.

It is another object of the present invention to provide a cable actuated digital vehicle cargo security system in which the moveable rocker member is magnetic or is associated with a magnet.

It is another object of the present invention to provide a cable actuated digital vehicle cargo security system in which the magnet associated with the moveable rocker member co-operates with a magnetically actuated switch.

It is another object of the present invention to provide a cable actuated digital vehicle cargo security system in which the moveable rocker member is held in its position remote from the switch by a spring.

It is another object of the present invention to provide a cable actuated digital vehicle cargo security system in which the switch generates an output signal to a digital counter to index the counter when the rocker member is moved from its position remote from the switch.

It is another object of the present invention to provide a cable actuated digital vehicle cargo security system in which a spring-loaded pushbutton mechanically linked to the moveable rocker member causes the rocker member to move from its position remote from the switch when the pushbutton is depressed.

The above objects are achieved by the cargo security system of the present invention which is designed for use on a vehicle of the type having an enclosed cargo compartment with an access door. The door has a latch including handle with an opening. The handle is moveable between a first position in which opening of the cargo door is prevented, wherein the handle opening is aligned with an opening in a part attached to the exterior surface of the cargo door, and a second position in which the cargo door can be opened, wherein the handle opening is out of alignment with the opening in the attached part.

The security system includes a digital counter mounted on the cargo door and a cable having one end anchored to the cargo door. The free end of the cable is adapted to extend through the aligned openings in the handle and attached part, when the handle is in its first position. Means are provided for retaining the free end of the cable after it has been inserted through the aligned openings in the handle and the attached part.

The cable end retaining means is connected to the counter. The retaining means causes the number on the counter to change in response to the release of the retained cable end by the cable end retaining means.

The cable end retaining means includes a spring-loaded friction wheel situated within a housing. The friction wheel is situated to engage the cable after the free end of the cable is inserted into a channel in the housing.

A magnetic rocker member and a magnetically actuated switch are situated within the housing. The rocker member is moveable relative to the switch between a proximate position and a remote position. Movement of the rocker member from its proximate position to its remote position actuates the switch to generate an output signal to the counter to cause the number displayed on the counter.

A pushbutton controls the position of the rocker member. The rocker member is normally urged toward its proximate position by a spring. Depressing the pushbutton causes the rocker member to move from its proximate position toward its remote position, against the action of the spring. As the rocker member is moved away from the switch, the switch is actuated to generate an output signal to the counter to change the displayed number.

BRIEF DESCRIPTION OF THE SEVERAL VIEWS OF DRAWINGS

To these and to such other objects that may hereinafter appears, the present invention relates to a cable actuated digital vehicle cargo security system as described in detail in the following specification and recited in the annexed claims, taken together with the accompanying drawings, in which like numerals refer to like parts and in which:

DETAILED DESCRIPTION OF THE INVENTION

The present invention is designed for use with any type of vehicle that has an enclosed cargo area with an access door which can be secured by a latch adapted to accept a seal. However, the present invention is primarily intended for use for securing cargo on trucks moving from one location to another location. Accordingly, the invention is disclosed herein as it would be used on a truck with an enclosed cargo area secured by a roll-up cargo door having a factory supplied cargo door latch with a J-hook which can be moved into a position where it engages a member situated in the bed of the vehicle to keep the door in the closed position. It is to be understood that the invention could be easily adapted by one skilled in the art for use with other types of vehicles, with vehicles with other types of cargo doors, or with cargo doors with other types of latches designed to accept a seal.

Figure 1:
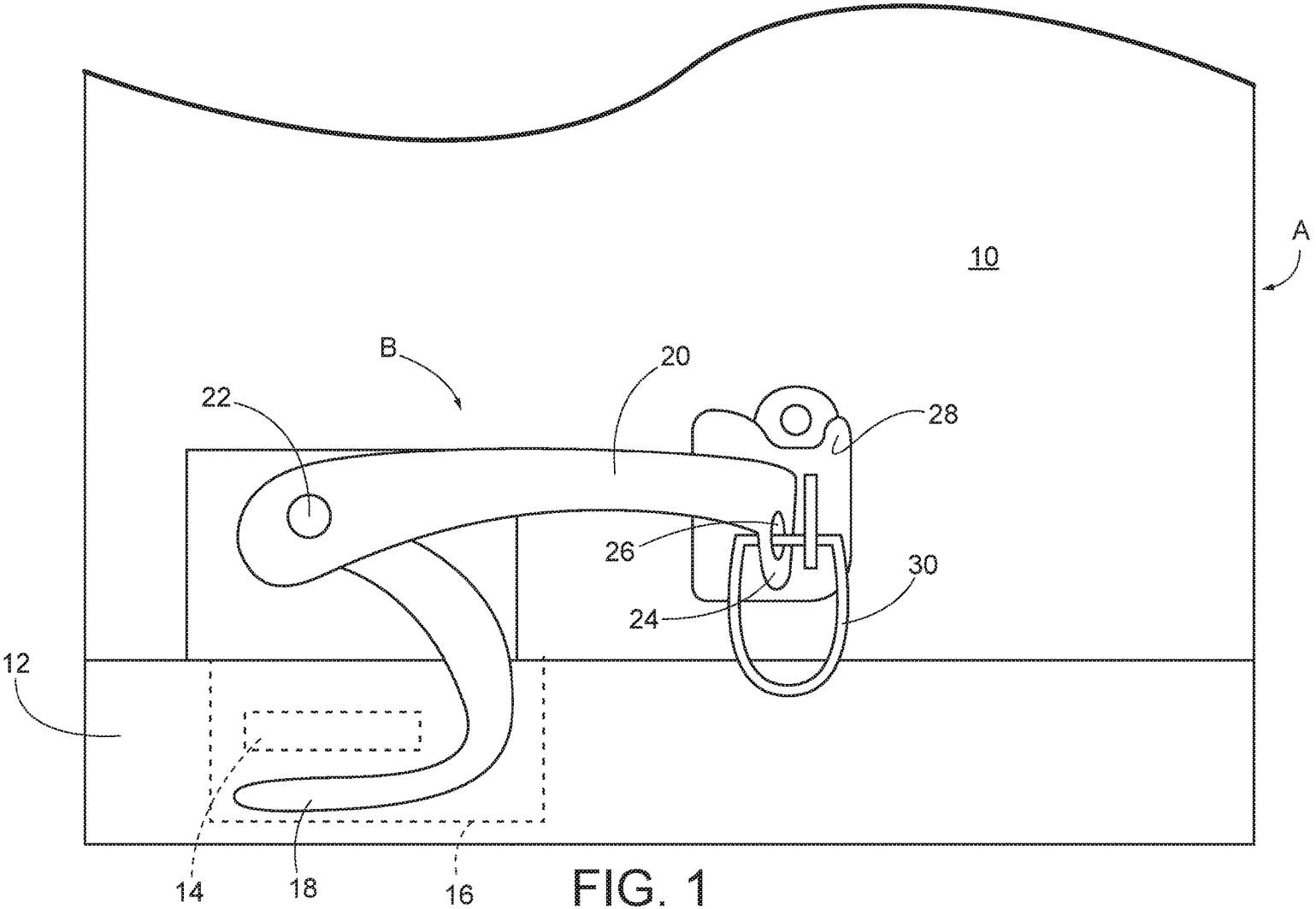
FIG. 1 PRIOR ART
FIG. 1 is an elevation view of an access door for a cargo compartment of a truck with a standard factory supplied latch, as it would appear after the door is secured and a conventional seal is applied.

FIG. 1 illustrates a vehicle such as a truck, generally designated A, with a standard factory installed latch, generally designated B. Latch B is shown as mounted on the exterior of roll-up type the access door 10 situated within an opening defined in part by the truck bed 12. Truck bed 12 includes a stationery part 14 located within a recess 16 in the truck bed. The stationery part is designed to be engaged by the J-hook 18 of latch B.

Latch B includes a handle 20 which controls the position of J-hook 18. The handle is rotationally mounted on door 10 for movement about shaft 22. The handle and J-hook move together as a unit. FIG. 1 shows the handle and J-hook in a first position wherein the J-hook engages part 14 to keep the door closed. Rotating the handle in a counterclockwise manner to a second position will cause the J-hook to disengage part 14, such that the access door can be opened.

The end of handle 20 has a downwardly extending portion 24 with an opening 26. Permanently attached to the exterior surface of door 10 is a part 28 which also has an opening (not visible in the figure). When handle 20 is in its first position, as seen in FIG. 1, opening 26 in handle portion 24 aligns with the opening in part 28. With the handle in that position, a physical seal 30 can be inserted extend through the aligned openings and the ends of the seal can be fastened together to form a loop. If the seal remains intact when the truck arrives at its destination, it indicates that the cargo door has not been opened. This is the conventional way of using a seal as a visible indicator of whether a cargo access door has been opened in transit.

Figure 2:
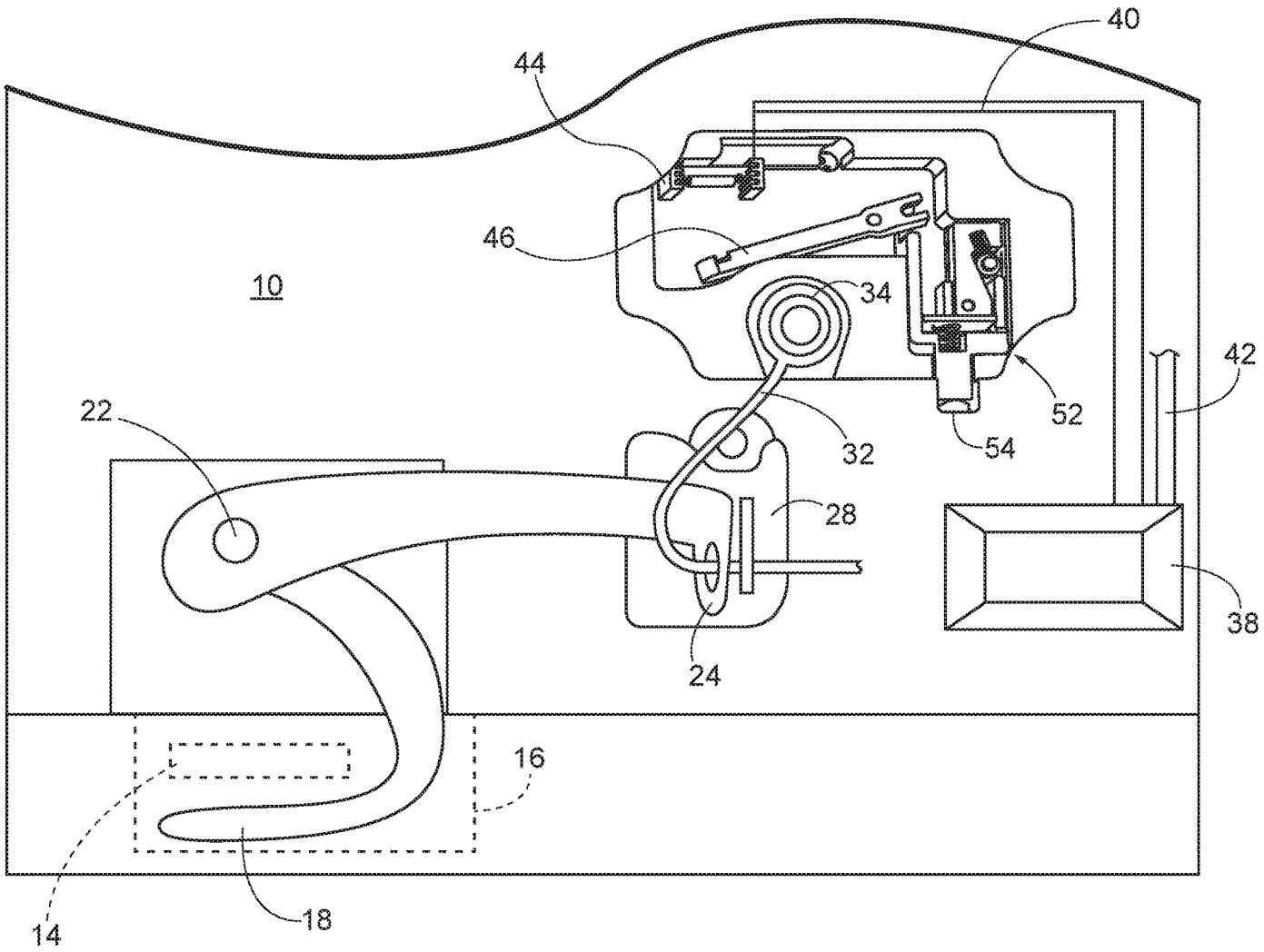
FIG. 2 is an elevation view of the truck access door and latch of FIG. 1 as it would appear with the security system of the present invention mounted thereon.
Figure 3A:
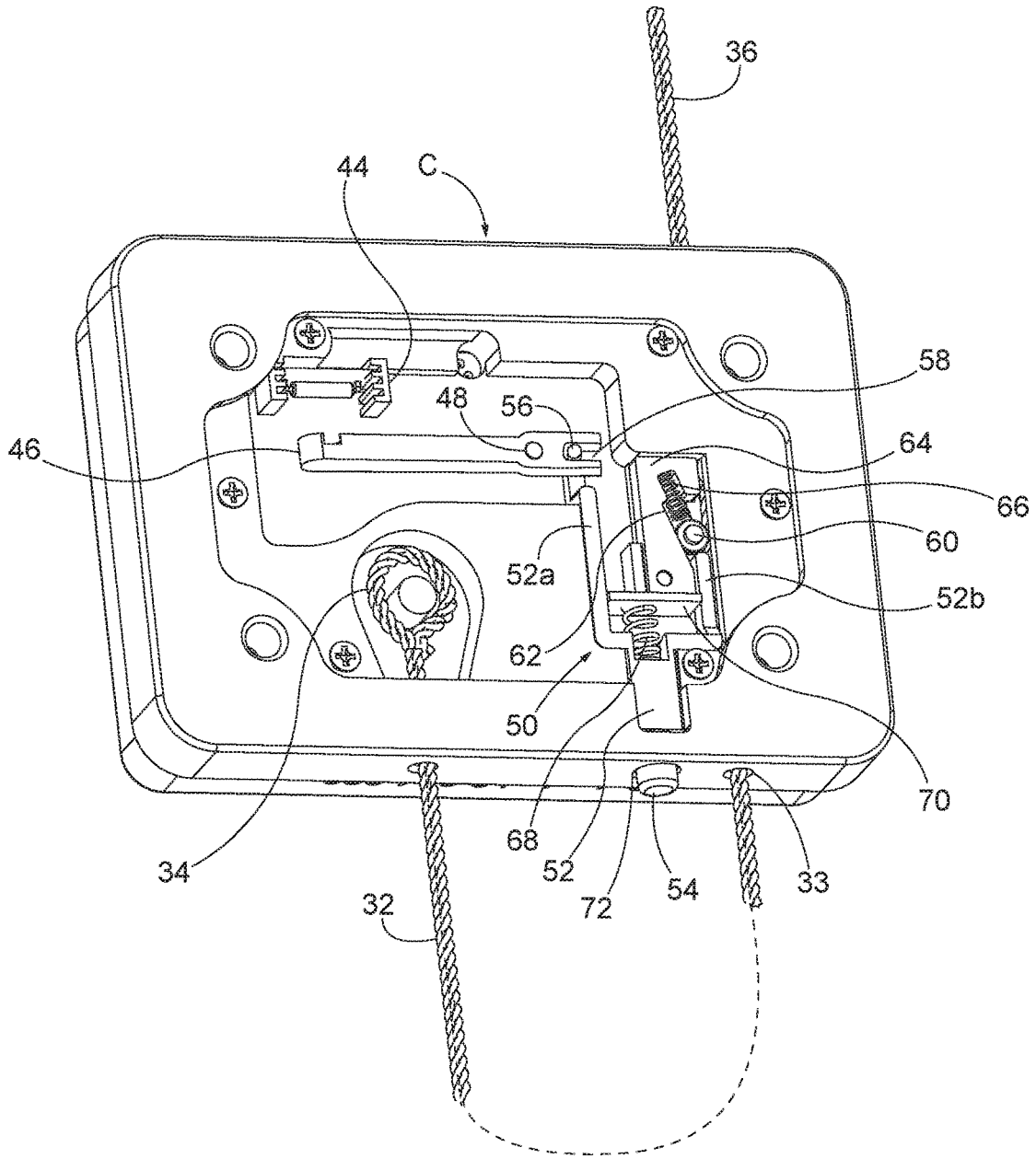
FIG. 3A is an interior view of the housing of the present invention showing the parts in the cable end retaining position.
Figure 3B:
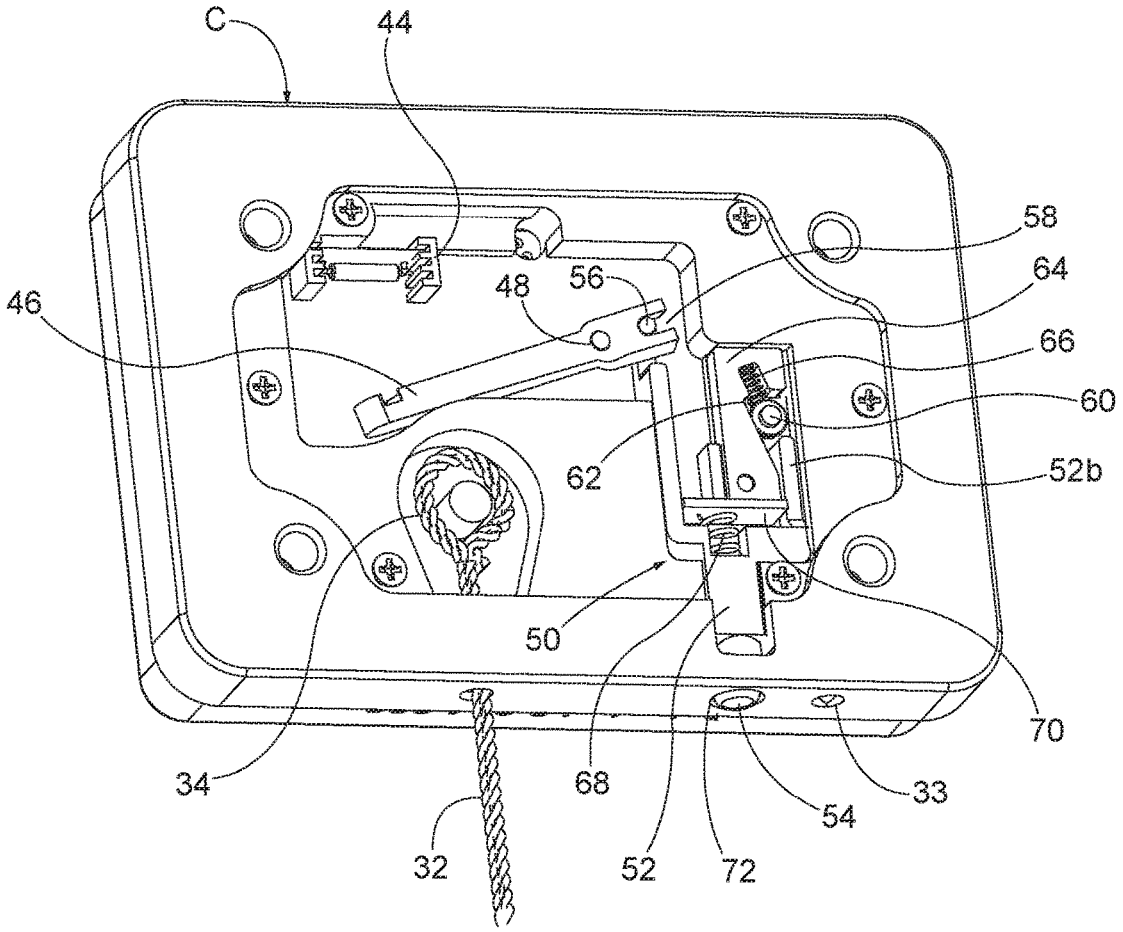
FIG. 3B is a view similar to FIG. 3A showing the position of the parts after the cable end has been released.
Figure 4:
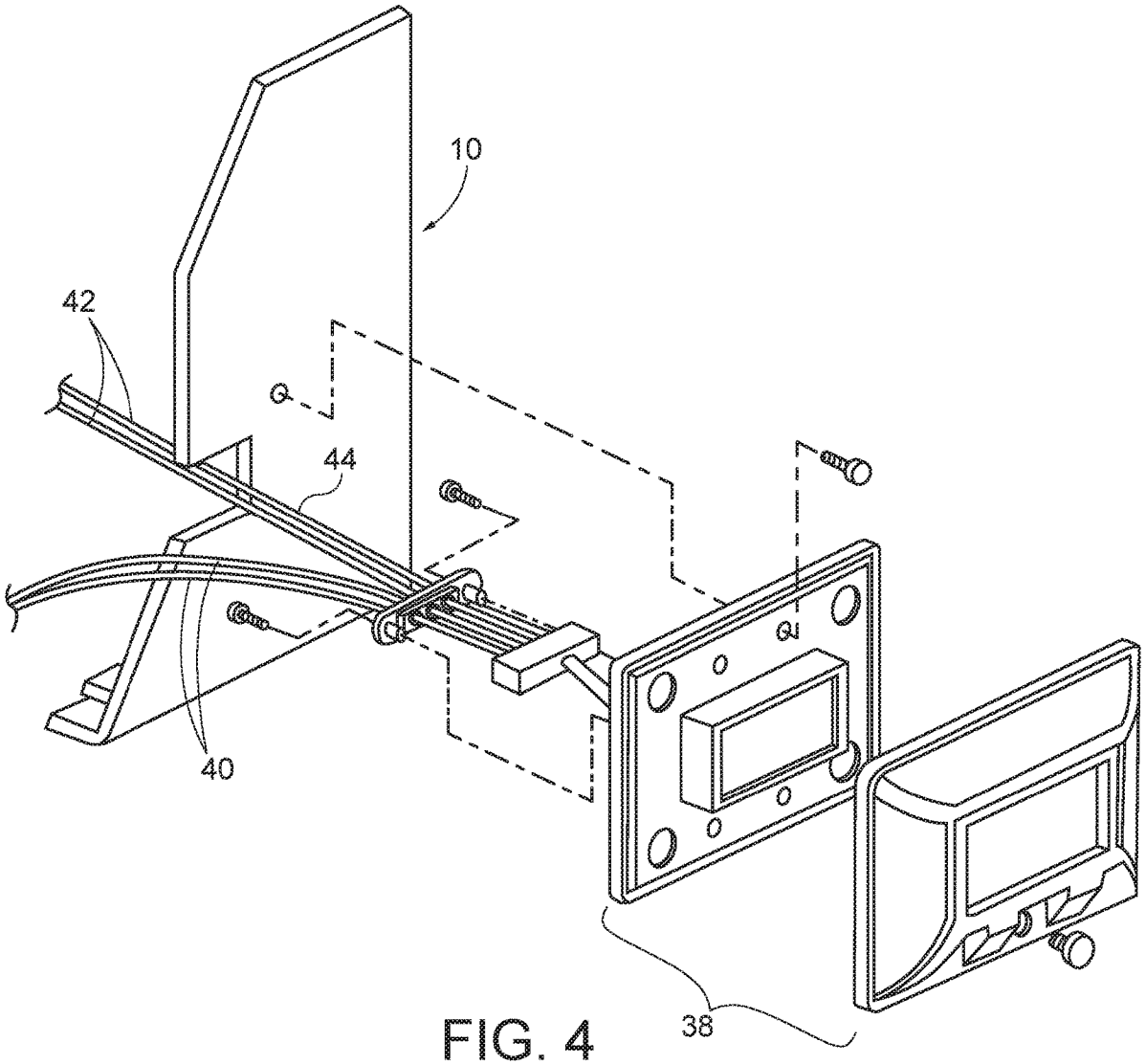
FIG. 4 is an exploded perspective view of the counter and connecting wires.

FIGS. 2, 3A and 3B illustrate the present invention which is suitable for use with any vehicle having an access door to an enclosed cargo compartment with a factory installed latch designed to accept a conventional plastic or metal seal. The security system includes a steel wire rope or cable 32 having an end 34 fixed to the access door and a free end 36. Means are provided for retaining the free end 36 of the cable in a channel 33 which extends through a housing, generally designated C which is fixed to the exterior surface of the door.

A digital counter 38 is also provided. Counter 38 is mounted on the exterior of the truck door 10 at a location near latch B where it is visible to a person positioned to open the access door. Counter 38 is connected by means of wires 40 to the cable end retaining means. It is also connected to a power supply by wires 42.

The cable end retaining means takes the form of a magnetically actuated switch 44 which may take the form of dry reed pipe and a moveable rocker member 46. Switch t 44 is connected to counter 38 by wires 40.

Rocker member 46 is formed of magnetic material or has a magnet embedded in it or associated with it. The magnet of the rocker member is aligned with switch 44 when the rocker member is in position proximate the switch, as illustrated in FIG. 3A.

Rocker member 46 is mounted on and rotatable with respect to a fixed shaft 48. Rocker member 46 can move between a position proximate switch 44, as seen in FIG. 3A and a remote position, as illustrated in FIGS. 2 and 3B. As the rocker member moves away from the switch, the switch generates an output signal to counter 38 through wires 40. That output signal causes the number displayed on the counter to change.

The position of rocker member 46 is controlled by a pushbutton assembly, generally designated 50. Assembly 50 includes a yoke-like part 52 from which a button 54 extends. Part 52 has a first leg 52*a* connected to the end of rocker member 46. This connection includes a pin 56 extending from end 52*a* which slides along a recess 58 in the end of the rocker member, such that the rocker member can pivot as part 52 moves linearly in a vertical direction.

The other leg 52*b* of part 52 acts as a stop for a rotatable friction wheel 60. Wheel 60 can move along an inclined slot 62 within a block 64 and is urged by spring 66 against cable 32 when the block is in the position shown in FIG. 3A. The external surface of wheel 60 has teeth or is rough such that it securely engages the surface of the cable. That configuration prevents the free end of the cable from being withdrawn from channel 33 of housing C by force because the more force that is applied to pull the cable out of the housing, the tighter the friction wheel retains the cable.

The pushbutton assembly 50 also includes another spring 68 which extends between the inside surface of part 52 aligned with button 54 and a stationery part 70 fixed to the bottom of block 64. Spring 68 is a strong spring and acts to urge part 52 downward such that the rocker member is moved toward its position proximate switch 44, the friction wheel engages the cable and button 54 is move toward its undepressed position. Movement of the rocker member toward switch 44 causes the switch to generate an output signal to the counter which sets the counter to display a random number.

When button 54 is depressed, part 52 is moved upward against the urging of spring 68. That causes the rocker member to pivot in a counter-clockwise direction toward its remote position, as seen in FIG. 3B such that switch 44 generates an output signal to the counter causing the random number generator associate with the counter to change the number displayed on the counter. That also allows spring 66 to expand, relieving the pressure on friction wheel 60 such that the end of the cable can be withdrawn from the housing.

As seen in FIGS. 3A and 3B, the components of the cable end retaining means and the means of anchoring the end 34 of the cable to the access door are enclosed within and protected by housing C. Housing C is secured to the exterior of the cargo door by rivets or the like, not shown. Button 54 extends through an opening 72 in the bottom wall of housing C.

After the cargo compartment is loaded, the cargo door is closed and the latch handle is moved to the position where the J-hook engages the stationery part in the truck bed recess. In that position, the opening in the handle portion is in alignment with the opening in part 28 attached to the surface of the access door. The user inserts the free end of the cable through the aligned openings.

Button 54 is then depressed, which moves the pushbutton assembly upward such that the rocker member pivots to its remote position relative to switch. The free end 36 of the cable can then be inserted through channel 33 in the bottom of the housing.

The button 54 is then released. Spring 68 moves the pushbutton assembly downward causing the rocker member to move toward its position proximate switch 44 and spring 66 causes the friction wheel to bear against the cable such that the free end of the cable is securely retained within the housing. At the same time, the reed switch generates an output signal to the counter. That causes the random number generator in the counter to set the counter to a number. That number will remain on the counter until button 54 is pushed again.

The truck can then travel to its destination. At the same time, the number set on the counter is transferred to the destination. The number can be transferred with the truck, as part of the shipping documents or separately, via the Internet, radio transmission or any other means. At the destination, the receiving party compares the transferred number with the number on the counter. If the numbers match, the receiving party knows that the end of the cable has not been removed from the housing, the access door has not been opened in transit and that the cargo is intact.

On the other hand, if the numbers do not match, that is an indication that the counter has been actuated by an output signal from the switch due to movement of the rocker member in response to the depression of the button. That may mean that the cable has been withdrawn from the housing and that the handle on the access door may have been move to open the door. In that event, the receiving party may refuse the cargo or at least be alerted to inspect the cargo carefully before accepting it.

While only a single preferred embodiment of the present invention has been disclosed for purposes of illustration, it is obvious that many modifications and variations could be made thereto.

It is intended to cover all of those modifications and variations which fall within the scope of the present invention, as defined by the following claims:

1. A cargo security system for a vehicle of the type having a cargo access door to an enclosed cargo compartment with a latch including handle with an opening, the handle being moveable between a first position in which opening of the cargo door is prevented, wherein the handle opening is aligned with an opening in a part attached to the exterior surface of the cargo door and a second position in which the cargo door can be opened, wherein the handle opening is out of alignment with the opening in the attached part, the security system comprising a digital counter, a housing, a cable having a first end anchored to the cargo door and a second end adapted to extend through the aligned openings and into said housing, when the handle is in its first position, a magnetically actuated switch connected to said digital counter, an assembly located within said housing, said assembly comprising a magnetic member moveable relative to said switch between a proximate position and a remote position to change the state of said switch, and a cable retaining member manually movable between retaining and non-retaining positions to move said magnetic member between said proximate position and said remote position, said second cable and end being retained within said housing by said cable retaining member when said cable retaining member is in said retaining position and released from said housing when said retaining member is in said non-retaining position, wherein the change of stat of said switch causes the number on said counter to change.

2. The system of claim 1 wherein said magnetic member comprises a pivotally mounted rocker member.

3. The system of claim 1 wherein said magnetic member is mechanically linked to said cable retaining member.

4. The system of claim 1 wherein said cable retaining member comprises first and second portions, one of said portions being mechanically linked to said magnetic member.

5. The system of claim 4 wherein the other portion of said cable retaining member retains said second cable end within said housing when said cable retaining member is in said retaining position.

6. The system if claim 1 wherein said cable retaining member is urged toward said retaining position.

7. The system if claim 1 wherein said assembly further comprises a spring urging said cable retaining member toward said retaining position.

8. The system of claim 1 further comprising a spring-loaded friction wheel associated with said cable retaining member, said wheel being in contact with said second cable end when said second cable end is situated within said housing.

* * * * *